United States Patent [19]

Logue

[11] 4,050,101

[45] Sept. 27, 1977

[54] BAFFLE FOR TOILET BOWL

[76] Inventor: Clyde Sherman Logue, 119 Minerva Road, Daytona Beach, Fla. 32020

[21] Appl. No.: 579,713

[22] Filed: May 21, 1975

[51] Int. Cl.[2] ..... A47K 17/00

[52] U.S. Cl. ..... 4/1; 4/DIG. 5

[58] Field of Search ..... 4/1, 10, 231, DIG. 5; 138/39; 198/171

[56] References Cited

U.S. PATENT DOCUMENTS

| | | | |
|---|---|---|---|
| 920,951 | 5/1909 | Harrison | 198/171 |
| 1,451,272 | 4/1923 | Robinson | 138/39 |
| 2,407,005 | 9/1946 | Haley | 4/1 X |
| 2,808,594 | 10/1957 | Hodgson | 4/1 |
| 3,334,358 | 8/1967 | McPherson | 4/10 |
| 3,723,998 | 4/1973 | Wehr | 4/1 |

*Primary Examiner*—Henry K. Artis

[57] ABSTRACT

An attachment for a conventional toilet bowl in a commode. The arcuate device for diverting and directing the swirling water created by flushing, into the exit waste conduit of the toilet bowl.

A non-corrosive curved baffle, capable of deflecting and diverting water. The baffle is securely positioned below the still water level of a conventional toilet bowl to direct and force swirling water directly into the outlet conduit means at the base of a conventional commode for the purpose of saving water.

6 Claims, 6 Drawing Figures

BAFFLE FOR TOILET BOWL

BACKGROUND OF THE INVENTION

In the prior art a number of commodes have been equipped with conventional water closets. A water closet, of course, serves as a storage tank for water used to flush out the waste contents of a conventional toilet bowl in a commode. It has been generally considered that the more water stored in the water closet, the more complete the flushing action. In the older, more elaborate water closet it was not uncommon for a volume of from 2 to 4 cubic feet of water to be stored in the closet. More modern day water closets hold from approximately 0.5 to 2 cubic feet of water to be used for flushing. This amounts to a volume of water varying from approximately 5 to 6 gallons of water, for an average conventional toilet.

In addition, more modern day toilet bowls are designed so as to provide an ingress conduit positioned to one side of the generally circular bowl area and directed in such a manner as to provide a generally swirling pattern of water in the bowl, flowing from the water closet. This is done to allow the flushing water to swirl about the generally circular or elipitical commode bowl to keep the interior thereof generally clean. Certainly, the swirling action of the water provides a more sanitary interior bowl. It is probably for this principal reason that the swirling action of the water is accomplished by positioning and direction of the ingress conduit.

Nonetheless, the swirling action of the water released from in most American-made bowls is in a counter clockwise direction.

The present invention is concerned with positioning in a permanent fashion a baffle on the inclined front interior wall of the toilet bowl so as to partially terminate or reduce the swirling action of the water released from the tank and direct the water more generally down into the exit conduit so as to generally save water.

It should be understood that the swirling action described above works against the force of gravity, and although it has as its principal object a cleaning and sanitary action, it also serves to waste water by working against the force of gravity. In other words the flow of fluid and other waste material out of the base of the toilet bowl by means of the swirling action results in a waste of water.

It is one objective of this invention to provide a water directing baffle to be permanently located on the interior, front inclined wall of the commode bowl to capture the kinetic energy of the swirling water and thereby save water.

It is another objective of this invention to provide a generally curved, non-corrosive baffle with an extended backwall water diverting member that is permanently positioned in the bowl against the flow of the swirling water to direct the water in an expeditious means to the ingress conduit.

It is a further objective to provide a baffle that may be securely cemented with a water insoluble cement so as to provide a generally 40 to 50% saving of water. The saving is occasioned by the use of the approximately one-half the amount of water in the toilet bowl.

It is the further objective of this invention to provide a small water diverting baffle as an attachment for a conventional toilet bowl. The said baffle being made of plastic or an inexpensive metal and capable of accomplishing a $2.00 to $10.00 saving per month in the water bill of the average family or commercial business.

SUMMARY OF THE INVENTION

The present invention, therefore, is directed to an improved form of water diverting baffle that can be added as an attachment to a conventional toilet bowl. In the more preferred embodiment, the baffle will be made of plastic or a cheap metal that does not rust when used in water. In one of the preferred embodiments the device has a forward curved, arcuate wall section joined at its rearward end by a raised generally straight backwall member that is capable of diverting water into the egress means.

DESCRIPTION OF THE PREFERRED EMBODIMENT

Figure 1:
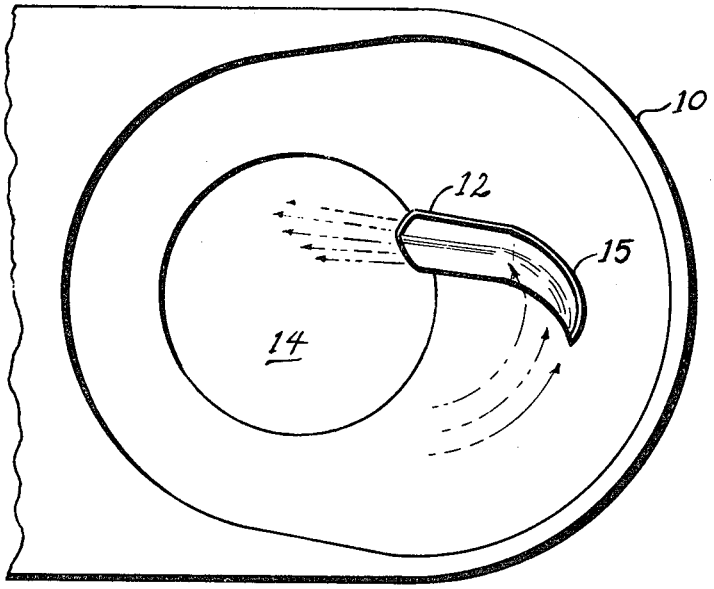
FIG. 1 is a top view of the baffle in a toilet bowl.
Figure 6:
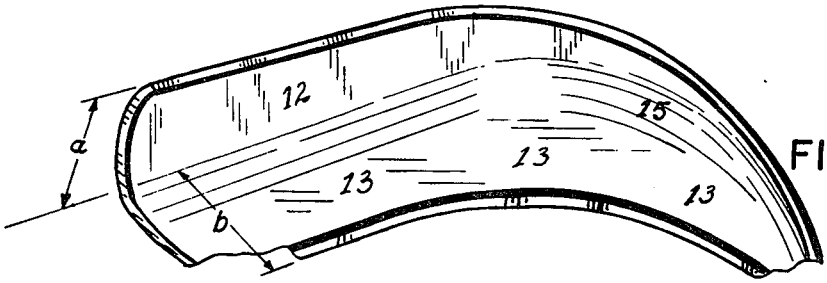
FIG. 6 is a plan view of an alternative embodiment of the baffle.

Referring to the drawings, the baffle illustrated FIG. 1 comprises a small object 11 with a curved forward wall member 15, a generally straight backwall member 12 and a base member 13. The radius of the curve wall usually will vary from about 70° to 120°, and is best illustrated in FIG. 6. The curve section 15 joins near the mid section of the baffle a backwall member 12.

The curved forward wall section 15 and backwall section 12 are connected through the length of the wall at the bottom of the wall, to the base member 13.

In one preferred embodiment, the top of the forward end of the arcuate forward wall section 15 may be positioned slightly below the still water level in the toilet bowl 10 and the rearward end of the backwall member **12*a* may be several inches below the water level. In one preferred embodiment the forward end of the curved section 15** may be about one eighth inch below the still water level.

The length from of the forward length section 15 to the base of the backwall member **12*a*** will usually vary from 3 to 8 inches, and the overall size of the baffle of cause may be indicated to some extent by the size of the toilet bowl in which said baffle is to be secured.

In FIG. 6, the arcuate, curved forward wall member 15 that joins backwall member 12 is connected to the curved arcuate forward section 15. The basewall 13 generally has a lateral demension varying from 1 to 3 inches, except in the curved area of the base member 13 where it comes to a point at the forward most area.

In the installation of the improved baffle of this invention, the basewall 13 is coated with an insoluble cement, over its entire contact surface 13B and the basewall is pressed into contact with the forward, inclined ceramic wall of the toilet bowl. A conventional silicone bathtub calk and seal element is excellent for this purpose.

In FIG. 1, diverted water, including waste materials is diverted from backwall member 12 into the waste exit means 14.

The backwall member 12 is usually molded or otherwise securely fastened to the backwall member 13 at an angle of from about 90° to 135°. Angle $\alpha$ usually varys from 90° to 135°.

In FIG. 1 illustrated, a conventional American-made toilet bowl is illustrated with water, swirling in a counter-clockwise direction. If the water were to flow and swirl in the opposite direction, i.e., clockwise, the installation shown in FIG. 1 would have to be reversed for maximum results. In other words, swirling water must strike the curved, arcuate forward wall member 15 and then the water is directed to flow against the raised backwall member 12 for purpose of rapid movement into the exit waste conduit means at the base of the commode.

Figure 2:
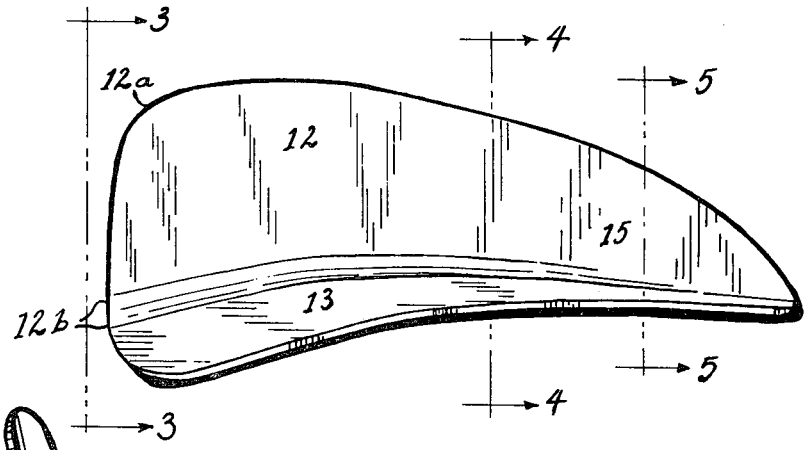
FIG. 2 is a plan view of the baffle.
Figure 3:
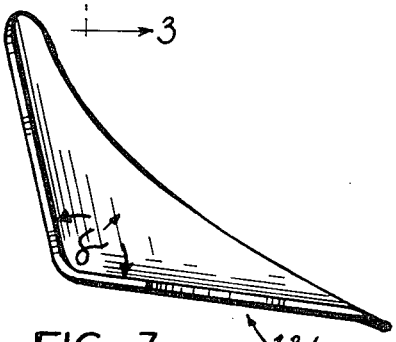
FIG. 3 is an end sectional view of FIG. 2 taken along line 3—3.

As particularly illustrated in FIG. 2, each and every corner and every surface of the baffle that may contact water and waste material must be smooth and rounded so as not to entangle or catch paper, waste material or other debris. This is an important feature of the invention. This can be generally accomplished by molding the entire baffle from a suitable plastic material.

Figure 4:
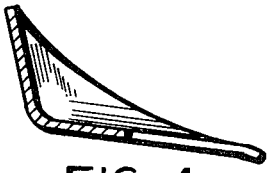
FIGS. 4 and 5 are sectional views taken along lines 4—4 and 5—5 respectively, of FIG. 2.
Figure 5:
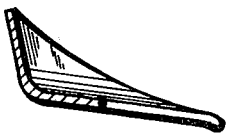

In FIG. 4 and in FIG. 5 the sectional views taken along the line 4—4 and 5—5 respectively are included in the specifications to illustrate the generally symmetrical cross section of the baffle.

In addition both of these views indicate that the angle between the back wall and the base wall maintains at or near the midsection of the baffle a generally constant angle with the base wall, in one prefered embodiment of the invention.

In such a molding operation the wall member including forward curved section 15 and rear wall member 12 may be joined at the bottom edge of the wall sections by molding, in a single operation or in two or more distinct operations the wall members 12 and 15 to the base member 13.

In another alternative embodiment the wall sections 12 and 15 may be part of a gradual curve that serves to shorten the path of the swirling water to the exit waste conduit. This embodiment illustrates that the back wall member can be either straight or curved, so long as the path of the swirling water to the exit waste conduit is shortened, thereby conserving and using the kinetic energy of the water.

I claim:

1. A baffle adapted to divert water in a conventional toilet bowl, wherein the said bracket is located in a commode equipped with an exit waste conduit at the base thereof, consisting of a base member and a contiguous wall member secured to one edge of said base member forming an angle therebetween in the range of from 90° to 135° wherein, the base member and the wall member each comprise a straight section and an adjacent curved section, the said base member having a forward edge and the contiguous wall member having an upward edge, wherein, in the curved section of the base member and in the curved section of the wall member the forward edge of the curved section of the base member and the upward edge of the wall member diverge at one end to a rounded point.

2. The baffle defined by claim 1, wherein the curved base member section has a radius of curvature in the range of 70° to 120°.

3. The baffle defined by claim 1, wherein one exterior surface of the baffle is adapted to be permanently secured to the interior of the toilet bowl, with the baffle being secured at a location below the still water surface level within the said bowl.

4. The baffle defined by claim 1 wherein the surfaces of the wall member and base member that contact water or waste material are smooth and rounded.

5. The baffle defined by claim 1 wherein the base member varies in width from approximately one to three inches.

6. In the combination of a toilet bowl equipped with a water diverting baffle permanently secured to one interior wall of the toilet bowl, the improvement comprising a baffle consisting of a base member secured to one edge of said base member forming an angle therebetween in the range of from 90° to 135° and a contiguous wall member, wherein the base member and the wall member each comprise a straight section and an adjacent curved section, the said base member having a forward edge and the wall having a upward edge, wherein, the curved section of the base member and in the curved section of the wall member, the forward edge of the curved section of the base member and the upward edge of the wall member diverge at one end of the baffle to a rounded point.

* * * * *